United States Patent [19]

Levad et al.

[11] Patent Number: 4,624,614

[45] Date of Patent: Nov. 25, 1986

[54] METHOD AND APPARATUS FOR PACK COOLING FLAT STOCK

[75] Inventors: Thomas M. Levad, Wilton; Lisle A. Jewell, Davenport, both of Iowa

[73] Assignee: Cargill, Inc., Minnetonka, Minn.

[21] Appl. No.: 718,516

[22] Filed: Apr. 1, 1985

[51] Int. Cl.[4] ..... B21B 43/10

[52] U.S. Cl. ..... 414/95; 198/422; 198/774; 414/786; 432/6; 432/80

[58] Field of Search ..... 414/29, 83, 92, 93, 414/95, 96, 786; 198/422, 774; 432/6, 80, 82

[56] References Cited

U.S. PATENT DOCUMENTS

| | | | |
|---|---|---|---|
| 1,484,664 | 2/1924 | Nelson | 198/422 |
| 2,748,635 | 6/1956 | Morgan | 198/422 |
| 3,679,072 | 7/1972 | Mueller | 414/96 X |
| 4,023,667 | 5/1977 | Appel | 414/118 X |

FOREIGN PATENT DOCUMENTS

| | | | |
|---|---|---|---|
| 028324 | 5/1981 | European Pat. Off. | 198/422 |
| 1950243 | 4/1971 | Fed. Rep. of Germany | 198/774 |
| 55-22466 | 2/1980 | Japan . | |

*Primary Examiner*—Leslie J. Paperner

*Attorney, Agent, or Firm*—Fitch, Even, Tabin & Flannery

[57] ABSTRACT

An apparatus for pack cooling flat stock to be retrofitted to a standard cooling bed. The apparatus includes collecting means having a plurality of stacker arms mounted for movement with respect to the stationary notch bars of the cooling bed between a first, retracted position, in which the arms underlie the notches in the stationary notch bars to permit uninterrupted transport of bar stock across the bed, and a second, lifting position in which the arms can lift a flat bar to a height sufficiently above the uppermost travel of the moving notch bars to permit a successive flat bar being transported across the cooling bed to be received in the notch of the stationary bar just vacated by the flat bar lifted by the stacker arms. Upon the return of the stacker arms to their first position, the flat bar held thereon will be placed on top of the newly-introduced flat bar to form a stack, resulting in a retarded cooling rate for the flat bars in the stack. The lifting and stacking operations may be performed as often as desired to obtain a stack of flat bars of the desired height, whereupon the stacker arms may be returned to their first position to permit the stack to be transported across the bed.

5 Claims, 7 Drawing Figures

METHOD AND APPARATUS FOR PACK COOLING FLAT STOCK

BACKGROUND OF THE INVENTION

The present invention relates to the manufacture of steel bar stock and, more particularly, to a method and apparatus for pack cooling flat stock on the cooling bed of a rolling mill.

In recent years, smaller, more efficient steel mills, sometimes called mini-mills, have become an increasingly important segment of the domestic steel industry due to their ability to economically compete with the manufacturers of imported steel. Such mini-mills usualy manufacture specialty products including flat, round, angle and assorted merchant stock of various cross-sections.

Regardless of the type of bar stock manufactured, it is desirable to slow cool the product in order to relieve residual inner stresses formed by non-uniform cooling and to render the stock softer and, thus, more suitable for cold working. After hot-rolling, the stock is air-cooled. This type of cooling results in formation of pearlite, which is normally soft. However, to obtain these results, the cooling rate must be sufficiently retarded in order to prevent the formation of bainite or martensite.

For merchant stock and angle or round stock, cooling beds having a plurality of both movable and stationary notch bars or rakes have been utilized. Such cooling beds may be 25 to 30 feet in width and up to 280 feet long. In operation, the bar stock is moved along the length of the cooling bed by reciprocating the movable notch bars with respect to the stationary notch bars. Consequently, the stock is lifted off the notches of the stationary bar by the notches of the moving bar and is then placed in the succeeding notches of the stationary bars. Cooling of the stock as it crosses the bed is aided by an updraft.

While a standard cooling bed of the type described above has proved satisfactory for use in cooling merchant stock of various cross-sections, as well as angle and round stock, a standard cooling bed does not provide a sufficiently slow cooling rate to prevent the formation of bainite or martensite when thin flat stock is being cooled by transporting such thin stock across the cooling bed one at a time. This has prompted the use of pack or stack cooling beds in which a number of flat bars are stacked before being air cooled on the bed. Typically, the flat stock is stacked with the most recently finished flat bar being placed on the top of the stack. By stacking the flat bars, their cooling rates are sufficiently reduced, particularly in the areas around the peripheries of each of the flat bars in the stack, to prevent the formation of bainite or martensite. Once a stack is formed in the initial row of notches in the pack cooling bed, the moving notch bars are activated to transport the stack across the bed.

However, just as a standard cooling bed is unsuitable for the slow cooling of flat bars, a pack cooling bed is unsuitable for the slow cooling of most merchant stock and angle and round stock because the cross-sections of such stocks preclude stacking. Thus, mills have had to choose between manufacturing only flat bars or merchant stock, round stock and angle stock or making substantial additional capital outlays for both a standard cooling bed and pack cooling bed in order to be able to manufacture all types of bar stock.

Accordingly, it is the primary object of the present invention to provide an improved cooling bed that may be utilized in the process of slow cooling stock of various cross-sections, including flat bars, angle stock, round stock and merchant stock.

More particularly, it is an object of the present invention to provide a cooling bed that permits bar stock, regardless of its cross-sectional configuration, to cool at a sufficiently slow rate to effect desired formation of pearlite in the stock.

Other objects and advantages may be appreciated upon reference to the following detailed description and the accompanying drawings.

SUMMARY OF THE INVENTION

The above-stated objects are fully met by a stacking apparatus that may be advantageously retrofitted to a standard cooling bed. The apparatus includes collecting means for lifting bar stock from the cooling bed while a movable notch bar transports additional bar stock forwardly. The collecting means then sets the lifted bar stock onto another bar stock in the cooling bed, thereby forming a stack, with the cooling bed notches intermediate the successive stacks being vacant. The collecting means moves between a first, retracted position, in which the collecting means underlies the notches in the stationary notch bars, which permits uninterrupted transport of bar stock across the bed, and a second, lifting position in which the collecting means lifts a flat bar to a height sufficiently above the uppermost travel of the movable notch bars, which permits a subsequently finished flat bar that is being transported across the cooling bed to be received in the notch of the stationary bar just vacated by the flat bar lifted by the collecting means. Upon the return of the collecting means to its first position, the flat bar lifted thereby is placed on top of the newly-introduced flat bar to form a stack, resulting in a retarded cooling rate for the flat bars in the stack. The collecting operation may be performed as often as desired to obtain a stack of flat bars of the desired height, whereupon the collecting means is returned to its first position to permit the stack to be transported forwardly on the bed. Additionally, if non-stackable bar stock is being cooled, the collecting means remains in its retracted position throughout the operation of the cooling bed.

DETAILED DESCRIPTION OF THE PREFERRED EMBODIMENT

Figure 1:
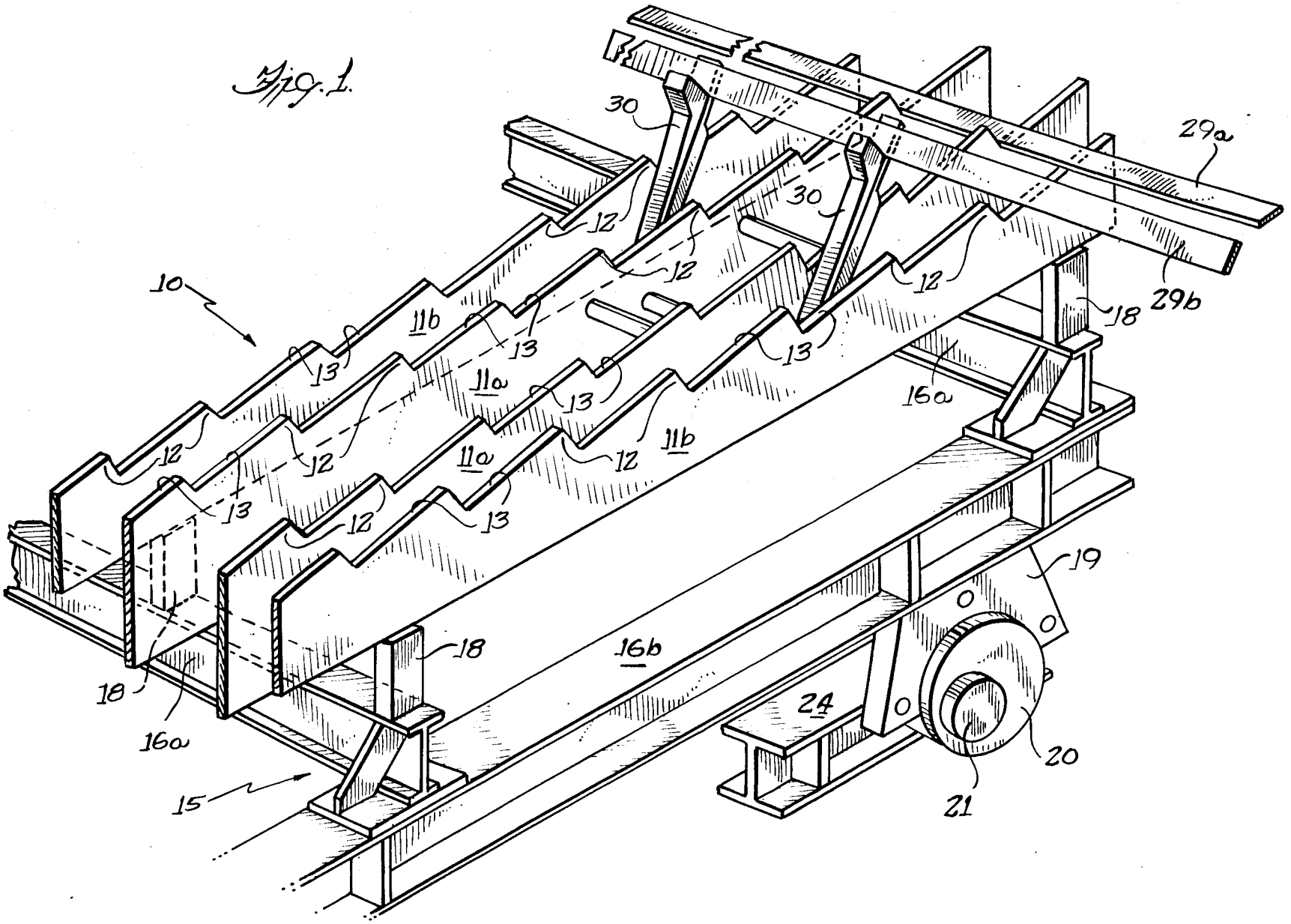
FIG. 1 is a fragmentary perspective view showing a cooling bed embodying the present invention.

Turning to the drawings, there is seen in FIG. 1 a perspective view showing a portion of a cooling bed, generally indicated by 10, embodying the present invention. As illustrated, the cooling bed 10 receives bar stock from the finishing end of a rolling mill (not shown) and includes a plurality of similar notch bars, generally indicated by 11, running the length thereof.

The notch bars 11 include stationary notch bars 11*a* and movable notch bars 11*b*, the movable notch bars 11*b* being reciprocable in a generally circular path with respect to the stationary notch bars 11*a*, as best seen by sequentially viewing the notch bars 11 in FIGS. 3–7. The notch bars 11 are each provided with steps or notches 12 having base sections 13 which incline downwardly in the forward (i.e., right to left) direction and having peaks at the rearward end of each step 12. Each notch forms approximately a 25° angle with respect to the horizontal (see FIG. 3) and the peaks are spaced apart approximately 5 to 6 inches. While only two stationary and two movable notch bars 11 are seen in FIG. 1, a typical cooling bed suitable for use in the present invention includes approximately 290 stationary notch bars 20 feet in length, and spaced 1 foot apart, and approximately 145 movable notch bars 20 feet in length, and spaced 2 feet apart.

Figure 2:
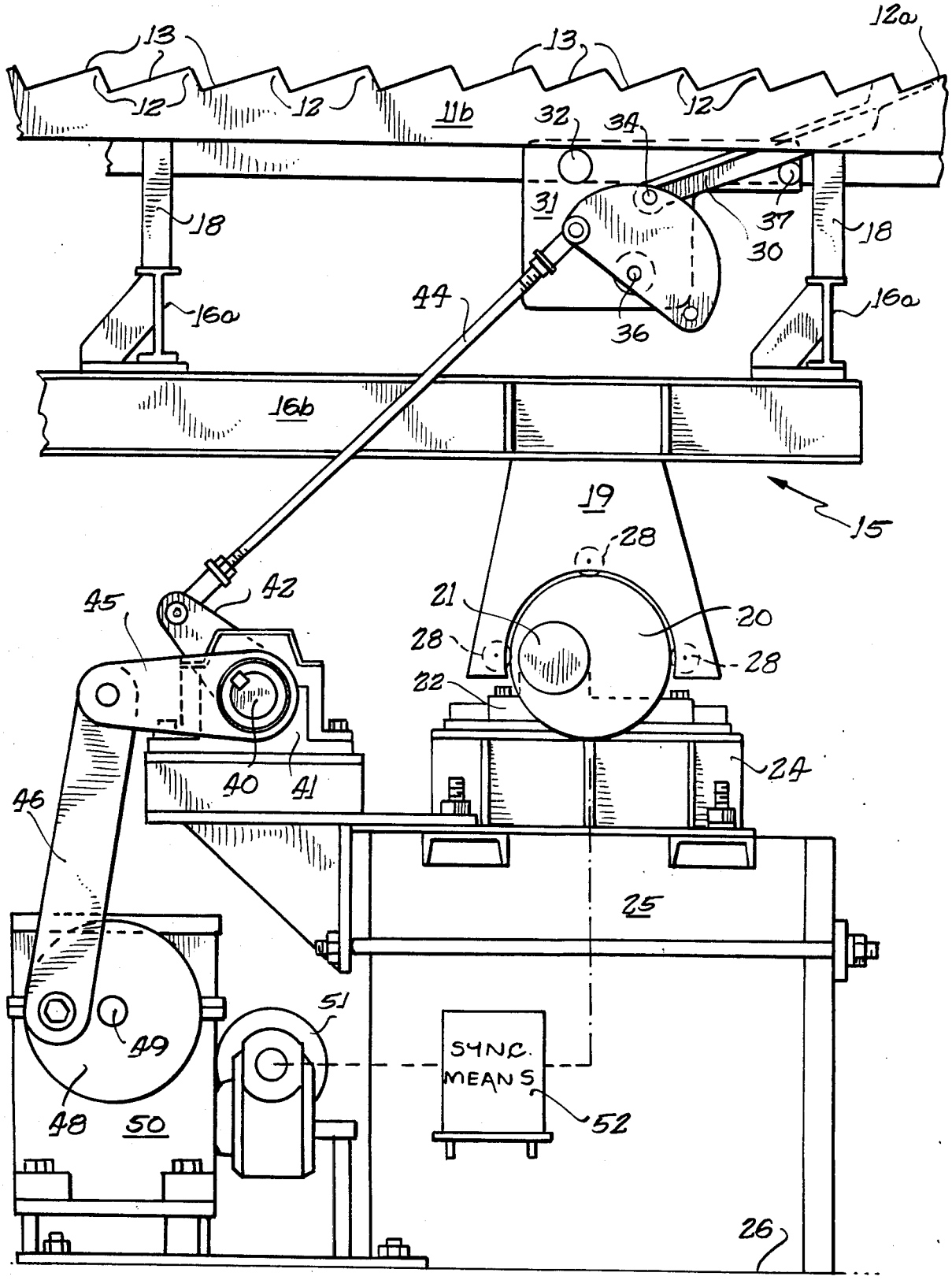
FIG. 2 is a side view of the cooling bed of FIG. 1 showing in greater detail the inventive stacking apparatus.

The support frame for the movable notch bars 11*b*, generally indicated by 15, is partially seen in perspective in FIG. 1. (The support structure for the stationary notch bars is not shown.) The support frame 15 includes a plurality of I-beams 16 running the length and width of the cooling bed 10. In the illustrated cooling bed 10, the movable notch bars 11*b* are supported on the frame 15 by means of upright brackets 18 secured by welding or other suitable means to cross I-beams 16*a*. The longitudinal I-beams 16*b* that run the length of the cooling bed include a plurality of downwardly extending brackets, such as that shown at 19, each seating an eccentrically-driven circular cam 20, all such cams 20 having their orientation and rate of rotation coordinated to properly reciprocate the movable notch bars 11*b*. Each cam 20 is supported on a shaft 21 carried in a journal block 22 in a bracket 22 (FIG. 2). The journal block 22 is supported on a length of I-beam 24 bolted to a pier 25 (FIG. 2) that is supported on the floor 26.

To facilitate rotation of the cam 20 within the bracket 19, the bracket includes three rollers 28 (best seen in FIG. 2) that engage the surface of the cam 20. The shaft 21 is driven by a motor (not shown) to eccentrically rotate the cam 20 and, in turn, reciprocate the frame 15 supporting the movable notch bars 11*b* with respect to the stationary notch bars 11*a*. When the movable notch bars 11*b* are reciprocated, a length of bar stock, such as those indicated generally by 29 in FIGS. 3–7, will be transported forwardly (i.e., from right to left) to a successive stationary notch 12 along the length of the cooling bed 10.

In keeping with the invention, collecting means is provided for lifting the flat bar stock 29 when it reaches a predetermined row of notches in the stationary notch bars so that the bar may be stacked on top of the following flat bar. Turning to the drawings, the collecting means includes stacker or lift arms, generally indicated by 30, that are associated with the stationary notch bars 11*a* at a stacking notch 12*a* in which two or more bars 29 may be stacked. As best seen in FIG. 2, each stacker arm 30 is supported on a bracket 31 secured to the stationary notch bar 11*a* by bolts 32. (While FIG. 2 shows only a single stacker arm 30, partially obscured by the movable notch bar 11*b*, the remaining stacker arms are identical thereto and are driven by a common motor and line shaft to be described below.) The forward end of the stacker arm 30 is pivotally connected at 34 to a bell crank 35, which, in turn, is pivotally mounted at 36 to the bracket 31.

During operation, the lift arm 30 rests on a free-wheeling roller guide 37 secured to the bracket 31. As the bell crank 35 pivots about its mounting 36, the lift arm 30 rolls across the guide 37 to change the attitude of the lift arm 30, thus effecting the stacking motion seen in FIGS. 3–7. The outer end of the stacker arm 30 opposite the pivot mounting 34 includes a flat support section 38 and a backrest portion 39 at a right angle thereto. The length of the support section 38 preferably should exceed the width of the widest flat bar stock 29 to be handled by the cooling bed 10, while the backrest portion 39 of the stacker arm 30 should be of a height greater than the height of the tallest stack of flat bars to be cooled on the cooling bed 10.

In order to actuate the stacker arms 30 in unison, a common oscillating line shaft 40 running substantially the width of the cooling bed 10 is operatively connected to the bell cranks 35 associated with each lift arm 30. Referring to FIG. 2, the line shaft 40 is journaled in a plurality of bearing supports, such as that indicated generally by 41, that are secured to the piers 25 supporting the movable notch bars 11*b*. The line shaft 40 is keyed to an actuating arm 42 which, at its outer end, is connected to a push rod 44 pivotally attaching the actuating arm 42 to the bell crank 35 to operatively connect the same.

To oscillate the line shaft 40, and thus actuate the stacker arms 30, the line shaft is also keyed to a drive arm 45 pivotally connected at its outer end to a link 46. A wheel 48 provided with a radially spaced pin 47 is driven on the output shaft 49 of a reduction gear box 50, with the link 46 connected to the wheel 48 by the pin 47. In the preferred embodiment, the wheel 48 and drive arm 45 are sized so that the line shaft 40 oscillates through an arc of approximately 80°.

A variable speed DC motor 51 is used to drive the reduction gear box 50. In order to synchronize the action of the stacker arms 30 with the reciprocation of the moving notch bars 11*b* in the manner shown in FIGS. 3–7, a programable controller, schematically shown at 52, is employed. The controller 52 preferably includes limit switches (not shown) to vary the number of successive flat bars 29 the arms 30 will stack, thus varying the height of the stack.

Figure 3:
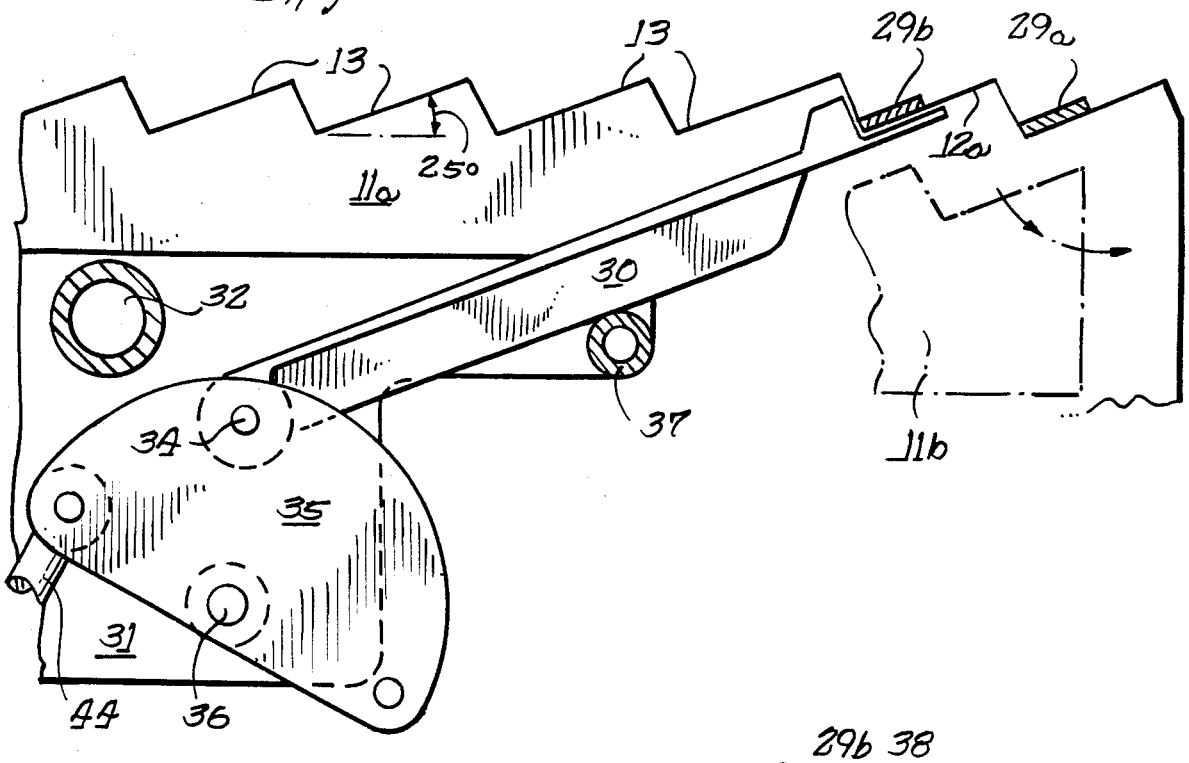
FIGS. 3–7 are side elevational views showing a sequence of operation of the stacker arms performing the inventive method of pack cooling.
Figure 4:
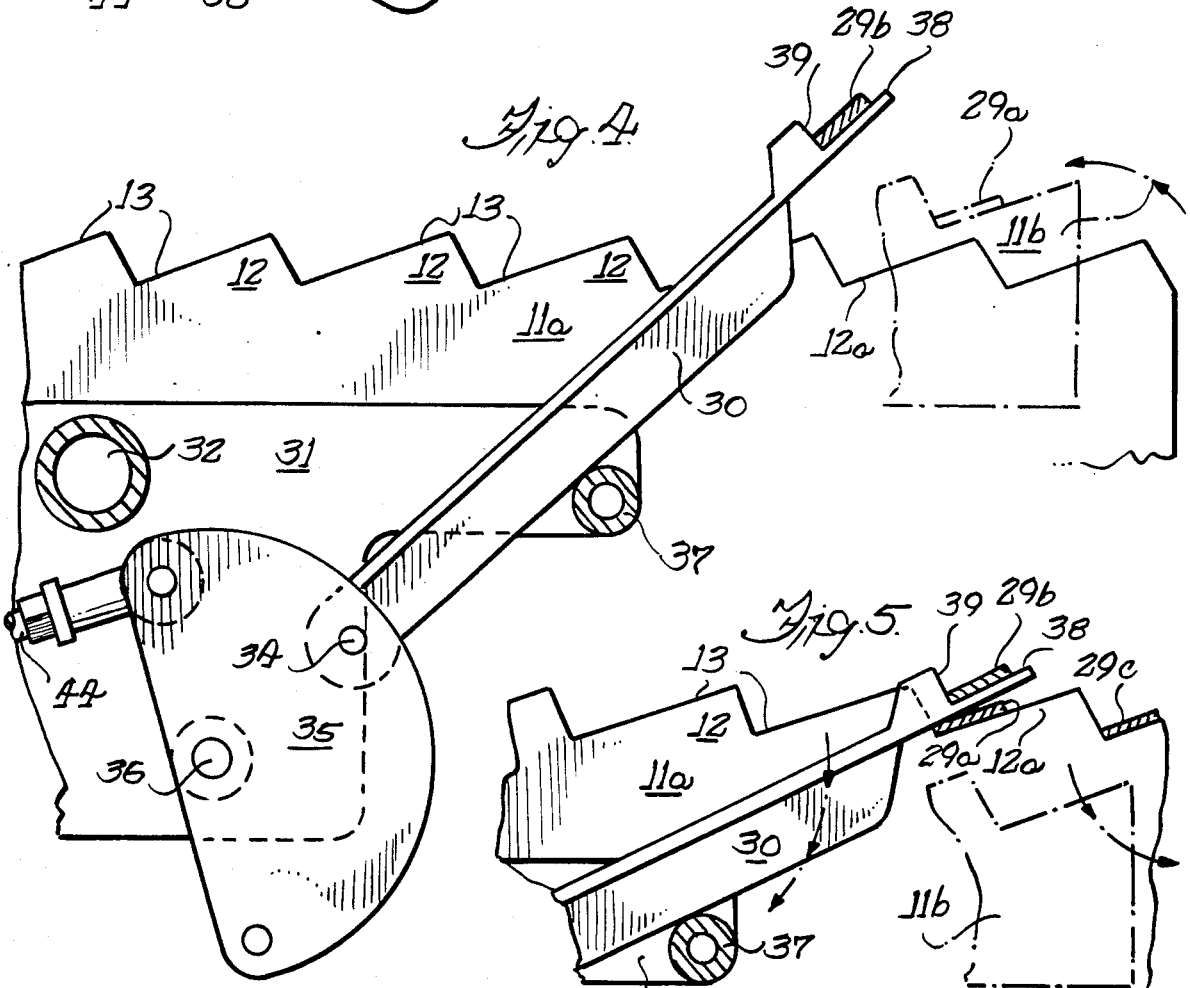
Figure 5:
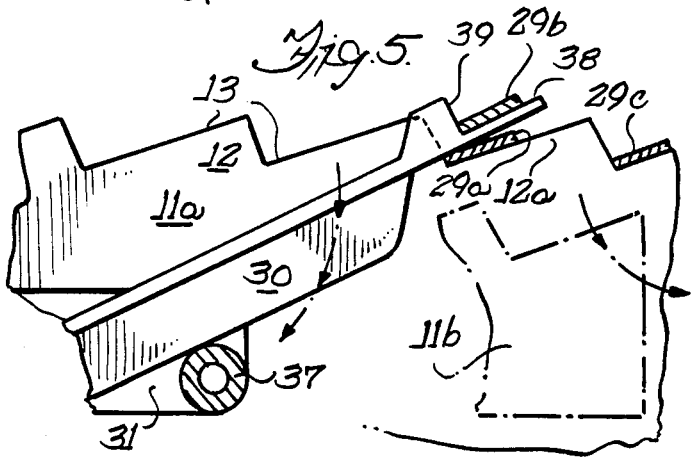
Figure 6:
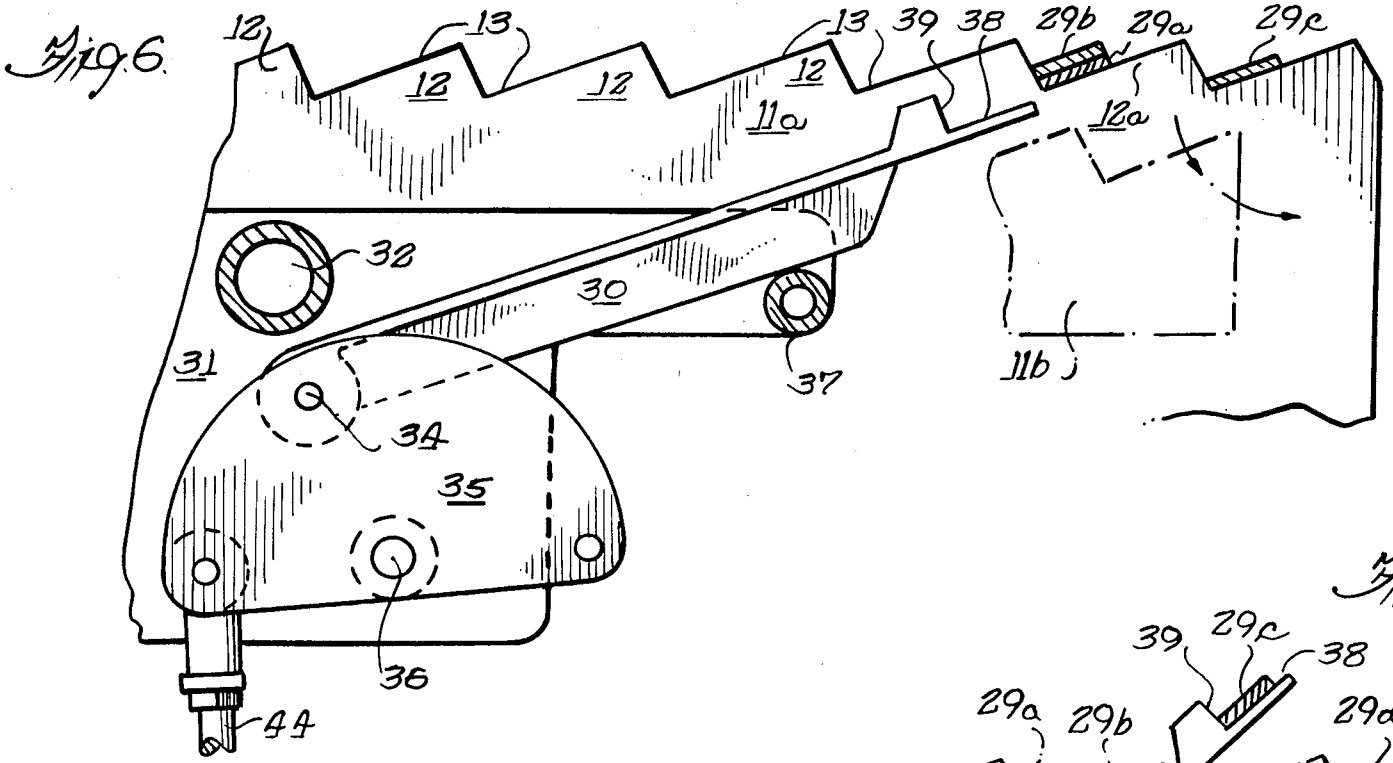
Figure 7:
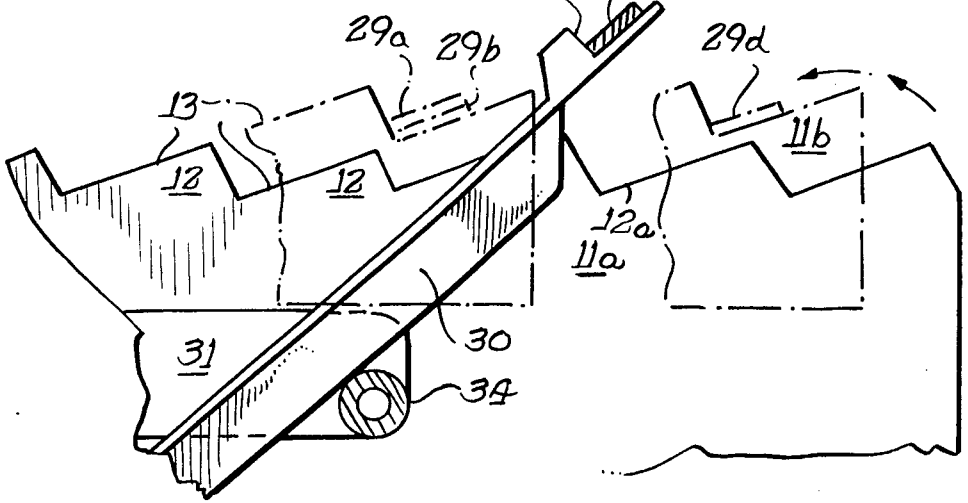

The operation of the pack cooling bed 10 is best seen by reference to FIGS. 3–7, which illustrate the sequence of stacking flat bars 29 in stacks of two. Briefly, the lift arm 30 will engage and lift the flat bar 29*b* from the stacking notch 12*a* to a position in which the lower surface of the support portion 38 clears the uppermost reach of the peaks of the movable notch bar 11*b*, while the movable notch bar 11*b* carries the flat bar 29*a* to the stacking notch 12*a*, i.e., the notch just vacated by the lifting of the flat bar 29*b* (FIGS. 3 and 4). The lift arm 30 is then retracted to stack the flat bar 29*b* on top of the flat bar 29*a*, while an additional flat bar 29*c* is received from the source in the stationary notch bar 11*a* (FIGS. 5 and 6). If stacks of flat bar two-bars high are desired, the lift arm 30 remains retracted so that it underlies the stacking notches 12*a* of the stationary notch bar 11*a*, thus permitting the stack of bars 29*a* and 29*b* to move from the stacking notch 12*a* upon the reciprocation of the movable notch bars 11*b* (FIG. 7). The flat bar 29*c* is carried into the stacking notch 12*a* by the movable notch bar 11*b* and, in turn, will be stacked on top of a flat bar 29*d*, as the cycle repeats. As can be appreciated, the number of flat bars in each stack is limited by the height of the backrest portions 39 of the lift arms 30 and the peaks of the notches 12 and can be varied by timing the number of concurrent cycles of operation of both the movable notch bars 11*b* and the lift arms 30 before the lift arms 30 remain retracted to allow the stack to pass out of the stacking notch 12*a*. When merchant stock or round or angle stock is to be cooled on the bed, the lift arms 30 remain retracted throughout the operation of the bed.

The above-described method, with the more-recently formed, and thus hotter, flat bars being the bottom bars in the stack, serves to further retard the cooling rate, in contrast to existing pack cooling beds where the more-recently formed bars are placed on the top of the stack. Because the bars are cooled by an updraft, with the hotter bars located at the bottom of the stack, the rising air will be heated as it passes the bottom bars in the stack. With heated air passing the upper bars in the stack, the cooling rate is further reduced.

Thus, it can be seen that a method and apparatus for pack cooling flat steel bar fully meeting the objects of the invention have been provided. While the invention has been described in terms of a preferred method and embodiment, it is not intended to limit the invention to the same. On the contrary, it is intended to include all modifications and alternatives falling within the scope of the appended claims.

What is claimed is:

1. A method of pack cooling a plurality of steel bars or the like on a cooling bed having stationary notch bars and movable notch bars to transport the steel bars from one end of the cooling bed to the other, comprising the repetitive steps of:

placing a first steel bar on the notch bars of the cooling bed so that it will be transported by the movable notch bars to a stacking notch in the stationary notch bar;

transporting the first steel bar to the stacking notch in the stationary notch bars;

collecting the first steel bar from the stacking notch;

placing a second steel bar in the stacking notch of the stationary notch bar; and returning the first steel bar on top of the second steel bar to form a stack.

2. The method of claim 1 wherein the step of collecting the steel bars is interrupted to permit the stack to move from the stacking notch forwardly across the cooling bed.

3. In conjunction with a cooling bed for finished steel bar stock having a plurality of stationary notch bars extending the length of the cooling bed, a plurality of movable notch bars extending the length of the bed, and means for reciprocating the movable notch bars with respect to the stationary notch bars so as to transport steel bar stock placed on the cooling bed at one end of the bed toward the other, a collection means comprising:

(a) a stacking notch on each stationary notch bar;

(b) collecting means comprising at least one stacker arm having a lifting portion for lifting steel bar stock from the stacking notch of each stationary notch bar and replacing the lifted steel bar stock in the stacking notch, the stacker arm being mounted for movement with respect to the stationary notch bars between a first, retracted position in which the arm underlies the notches in the stationary notch bars, and a second, lifting position in which the lower surface of the lifting portion of the stacker arm clears the stacking notch of each stationary notch bar above a plane defined by the uppermost point attained by the movable notch bars during the reciprocation thereof so that steel bar stock may be received in the stacking notch of the stationary notch bars;

(c) actuating means for lifting each stacker arm between its first, retracted position and second, lifting position; and (d) variable synchronizing means for adjustably coordinating the timing between the actuation of each stacker arm and the reciprocation of the movable notch bars.

4. The stacker apparatus of claim 3 wherein the actuating means comprises a line shaft extending substantially the width of the bed, and motor means including a drive wheel operatively connected thereto for reciprocating the line shaft, each stacker arm being pivotally mounted on a bell crank, with each bell crank being connected by a push rod to an actuating arm on the line shaft.

5. The combination of claim 4 further comprising a free-wheeling roller associated with each stacker arm for engaging the underside of its respective stacker arm and guiding the same between its first, retracted and second, lifting positions.

* * * * *